United States Patent [19]

Vaccaro et al.

[11] Patent Number: 5,012,830

[45] Date of Patent: May 7, 1991

[54] HAIRSTYLING METHOD AND DEVICE

[76] Inventors: John C. Vaccaro, 210 Brookdale Rd., Mahopac, N.Y. 10541; Paul D. Lupinacci, 219 Stone Ave., Yonkers, N.Y. 10701

[21] Appl. No.: 447,174

[22] Filed: Dec. 7, 1989

[51] Int. Cl.[5] ..... A45D 24/34

[52] U.S. Cl. ..... 132/213.1; 132/124; 132/145

[58] Field of Search ..... 132/122, 124, 125, 144, 132/145, 148, 149, 200, 212, 213, 213.1, 219, 273; 7/136

[56] References Cited

U.S. PATENT DOCUMENTS

| | | | |
|---|---|---|---|
| 472,449 | 4/1892 | Gaudin | 132/122 |
| 716,454 | 12/1902 | Martin | 132/148 |
| 1,051,415 | 1/1913 | Jones | 132/124 |
| 1,132,699 | 3/1915 | Wright | 132/213 |
| 1,457,726 | 4/1922 | Cornellier | 132/213 |
| 1,462,167 | 7/1923 | Crooms | 132/146 |
| 1,491,320 | 4/1924 | Spencer | 7/136 |
| 1,609,208 | 7/1925 | Schneeberger et al. | 132/144 |
| 2,150,260 | 3/1939 | Berry | 132/122 |
| 2,696,043 | 12/1954 | Maze | 132/213 |
| 3,877,472 | 4/1975 | D'Angelo | 132/145 |
| 4,163,143 | 7/1979 | Federico et al. | 132/145 |

*Primary Examiner*—John J. Wilson
*Assistant Examiner*—F. LaViola
*Attorney, Agent, or Firm*—Israel Nissenbaum

[57] ABSTRACT

A method for facilitated precision cutting of hair by one handed sectioning, combing and locking of hair into position for cutting and a device for effecting the method. The device comprises a combination of comb, sectioning and locking members arranged such that it provides for the rapid one handed sequential hairstyling functions of sectioning, combing and uniform locking of hair in position for cutting, clipping or trimming without the necessity of constant comb and finger manipulation and movement. A short comb, adapted to comb a straight portion of hair, is combined with a thin tapered elongated sectioning and locking bar. The comb and bar are hingedly connected and are movable relative to each other by use of a single hand and finger manipulation.

19 Claims, 3 Drawing Sheets

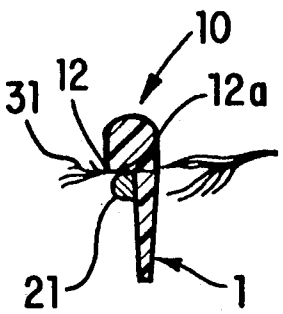
FIG. 7
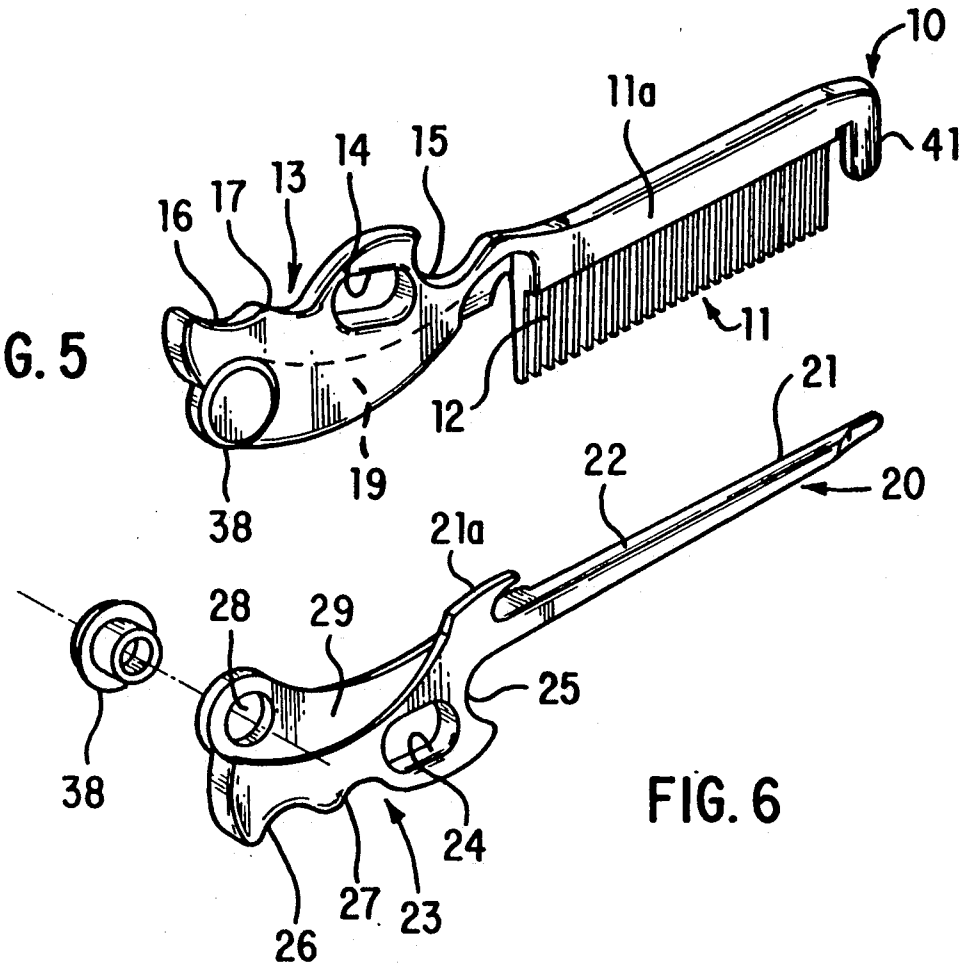
FIG. 5
FIG. 6

HAIRSTYLING METHOD AND DEVICE

BACKGROUND OF THE INVENTION

1. Field of the Invention

This invention relates to hairstyling instruments and devices and particularly to combs with combination elements for selecting and locking hair in position for cutting with a separate scissor, clipper or trimmer.

2. Description of Related Art

Various devices have been utilized to define a particular portion of hair on a person's head for selective cutting, clipping or trimming. These devices range from the simple bowl used to give children haircuts and similar full head cutting guides such as in U.S. Pat. No. 1,182,242; to devices such as described in U.S. Pat. No. 1,132,699, of a hand operated hair clamp with a spring action, to which a comb is conveniently obversely affixed. A standoff guide, in U.S. Pat. No. 1,359,343, keeps a comb at an adjustable distance from the head for selective length cutting.

Other devices, with a comb being combined with a second element, include those described in U.S. Pat. Nos. 1,051,415 and 1,462,167, in which combs are placed in hinged combination with hair straightening elements. In the former, hair is wedged between the comb and an adjacent flat bar to effect the straightening. In the latter patent, a pre-heated bar on the obverse side of the comb teeth is used for the hair straightening after the hair has been combed. U.S. Pat. No. 2,154,120 discloses a rat-tail comb with the "rat-tail" being hinged to the comb section and functioning as a sheath for the comb and as a curling device. In U.S. Pat. No. 681,740 a comb is integrated back to back with a scissor in order to eliminate the necessity of switching between the devices. However, because of their opposite interrelationship they cannot be used in tandem. In U.S. Design Pat. No. 269,820 a comb is integrated with an elongated wide platform member, with what appears to be a spring-like connection. A central longitudinal slot in the platform member appears to permit partial insertion of the comb therein. No function is however described for this device.

None of the aforementioned devices provides for the rapid one handed sequential steps of selective sectioning of hair, combing of the selected section to a desired cutting length, and positive uniform locking of the hair at the desired length for facilitated interfaced cutting with a scissors, trimmer or clipper.

BRIEF SUMMARY OF THE INVENTION

It is therefore an object of the present invention to provide a method for rapid precision cutting of hair, by a user such as a hairstylist or barber, with rapid one handed sequential steps of sectioning, combing and locking of hair for facilitated cutting or clipping and a device for use in effecting such method.

It is a further object of the present invention to provide such device wherein it is readily manually manipulable and provides for ease in sectioning thin layers of hair for more precise hair cutting.

It is a still further object of the present invention to provide embodiments of the hairstyling device of the present invention made with rigid, though lightweight metal and the more flexible plastic.

These and other objects, features and advantages of the present invention will become more evident from the following discussion and drawings in which:

BRIEF DESCRIPTION OF THE DRAWINGS

FIG. 5 is an isometric view of the separated comb half of the device;

FIG. 6 is an isometric view of the separated sectioning half of the device; and FIG. 7 is a front end sectioned view of the device closed on sectioned hair taken along line 7—7 of FIG. 3.

Figure 1:
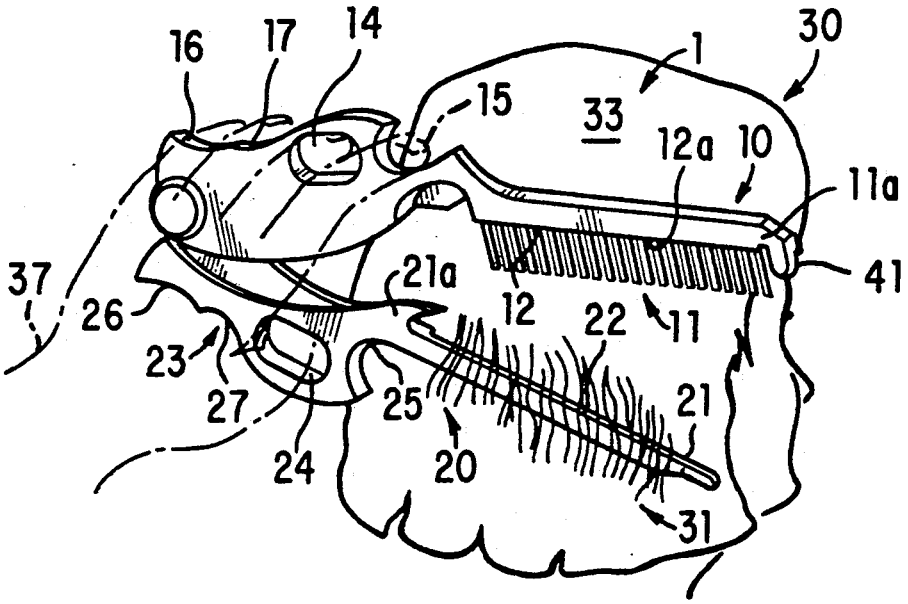
FIG. 1 is an isometric view of an embodiment of the device of the present invention shown sectioning a layer of hair.

It is the current widespread practice of hairstylists and barbers, in selectively cutting hair, to first comb a section of hair on a person's head with a comb and then to grasp the combed section between adjacent fingers of one hand. Thereafter, a scissor or clipper, held with the other hand, is used to cut the selected section of hair. This method is awkward since it requires constant comb and finger manipulation and movement. In addition, fingers are not ideal clamps and hair held therebetween tends to slip. Finally, the combination of comb and fingers do not readily permit thin sections of hair to be selectively cut.

DETAILED DESCRIPTION OF THE INVENTION

Generally the present invention comprises a method for precision cutting of hair on a person's head, comprising the rapid unencumbered sequential steps of sectioning of a layer of hair, i.e. separation and lifting of a selected portion of hair from the remaining hair; combing of the sectioned hair until a selected cutting length is reached; and uniform pressure locking of the hair at the selected cutting length during the combing; all with a one handed device which requires no position re-orienting in the user's hand. A separate cutting, clipping or trimming device, held by the other hand, as is the common procedure, is thereafter used for the cutting, clipping or trimming to the desired length. A sectioning member of the device is used to select (separate and lift) a portion of hair which can be as thin as ⅛ (3 mm). A combing member of the device combs the sectioned hair to the selected cutting length, with the hair then being clamped or locked into such length, with a uniform pressure, by the device, preferably by a combination of the sectioning and comb members. The user's fingers are used only for manipulation of the device and not in conjunction with any hair manipulation or clamping.

The present invention further comprises a hairstyling instrument or device, which is fully operable by one hand, for effecting the method of the present invention. The hairstyling device comprises integral means for sectioning, combining and locking layers of hair on a person's head with a uniform pressure (i.e. without slippage) for precise cutting by a separate cutting, clipping or trimming device. In a preferred embodiment of the present invention, the hairstyling device comprises a comb member with a gripping section for the hand and a short comb section with combing teeth extending from a base; and a sectioning member with a gripping section for the hand and a thin tapered elongated bar member. The comb and sectioning members are integrally hinged with one another, preferably with a distal end hinged attachment of the respective gripping sections, with the teeth of the comb section and the bar member being movable toward and away from each other, by the relative movement of the respective gripping sections, to and from an adjacent juxtaposition. The distal connection, at the ends of gripping sections of the comb member and sectioning member, is preferred since it permits a greater separation between comb section and bar member for greater latitude in hair thickness sectioning. However, a mid-point connection, similar to a scissors, is nevertheless otherwise fully as useful. The hinged connection is preferably a simple pin, nut and bolt, or rivet around which the sectioning and comb members adjacently rotate.

The free end of the bar member is adapted to be inserted beneath a layer of hair on a person's head and, for precision in sectioning a thin layer of hair (as little as ⅛"-3 mm), is preferably narrow, elongated and tapered to a blunted point (a sharp point, while operable, is not as desirable because of the possibility of inadvertant jabbing). To ensure that a proper section of hair is selected and held by the bar member, and to prevent hair from being pinched between the gripping sections of the sectioning member and comb members at their hinged point of attachment, the bar member is preferably provided with an end stop or hair catching element such as a small tooth-like protrusion extending in an upward direction and tilted towards the free end thereof. The stop element is located at a position slightly beyond the lateral interfacing of the bar member with the teeth of the comb section, on the side closest to the hinge point connection where it prevents hair from reaching the hinge point connection. In addition, a free space between the end of the combing teeth and the stop element (when the bar member and combing teeth are in adjacent juxtaposition) is provided to permit excess hair to either fall out or be loosely held without pinching during the hair locking phase.

The comb section is adapted to engage and comb the sectioned hair until a precise length for cutting is selected. At this point, with the hair still engaged with the combing teeth, the combing teeth and the bar member are manually brought together to lock the hair, at the selected length, for cutting by a scissors, trimmer or clipper held by the other hand. When cutting is completed, the comb member and sectioning member are manually moved apart, via movement of the gripping sections, for further sectioning, combing, locking and cutting until the hairstyling is completed. In the normal operating mode, the comb member is above the sectioning member, with the teeth of the comb section extending downwardly and with the bar member being situated such that it moves along the outer lateral surface of the teeth of the comb section, relative to the person's head. It is noted that differently oriented devices (i.e. mirror image reversed) are required for use by right and left hands in order to maintain such relative arrangement between comb member and sectioning member. Otherwise the right and left handed versions are identical in construction and operation. The following discussion relates specifically to the device as adapted to be used in the left hand and wherein the cutting device is held in the right hand. Mirror image modification provides the preferred version to be used with the right hand of a left handed hairstylist or barber.

In effecting the hair locking, a small platform or ledge member, laterally adjacent to the outside of the comb section, along the length thereof, acts as a stop for the bar member with hair being locked therebetween. In addition, the ledge member and bar member have a planar interface whereby hair locked therebetween is held with a substantially uniform pressure and is brought to a position substantially perpendicular to the person's head for facilitated cutting by the scissor, trimmer or clipper. It is desirable that the portion of the base of the teeth of the comb member, where the teeth are attached thereto, laterally coincides with the planar interface, in order to prevent an offset of the hair and possible pinching.

To further facilitate the cutting operation, and for greater precision in length cutting, the outwardly exposed adjacent portions of the bar member and ledge member are co-planar. As a result, a flat surface is formed to precisely guide cutting of the protruding hair, by providing a support guide for the scissor, trimmer or clipper.

In order to provide precise manual operation in the movement of the sectioning and comb members, in the aforementioned steps, each of the members, at a position adjacent the hinged connection, is provided with the gripping sections or handle conformed to the user's hand. Preferably, each of the gripping sections comprises at least one finger loop portion thereof which, on the sectioning bar member, permits insertion of the thumb, and on the comb member permits insertion of at least one other finger. The finger loops need not be closed provided that they are sufficient in their respective peripheral enclosures to provide leverage for the enclosed finger to enable the fingers to separate the comb member from the sectioning member. In addition, the fingers should have sufficient purchase on the sectioning and comb members to permit the fingers to draw the comb section and bar member together and to maintain relatively tight uniform compression therebetween in the half locking position. Finger pressure alone, which can be selectively controlled, provides the uniform compression locking between the comb section with ledge member and the bar member. For comfort, a conformed finger grip surface is provided on each of the gripping sections, adjacent the finger loop, for the non-enclosed fingers. The gripping sections of each of the comb and sectioning members should substantially adjacently overlap each other and preferably should also interfit with one another to provide an extensive interface to prevent skewing of the members from alignment with each other during use.

The device of the present invention is further utilizable in precise cutting of the downwardly extending hair ends adjacent a person's neck, such as for a bob cut, without awkward backward bending of the user's wrist. In such utilization, the device is flipped such that the thumb is used to control the comb member and the remaining fingers are used to control the sectioning member. The hairstyling device is held in a position perpendicular to the hair with the user's hand extending downwardly. In such position the bar member is adjacent the person's head and is inserted beneath the desired section of hair, which is thereafter moved outwardly into the teeth of the comb section. The hair ends extend perpendicularly downward from the interface between the bar and ledge members when the hair is locked therebetween for cutting. The device, for such utilization, is provided with a finger loop on both the gripping portions of the comb member and the sectioning member which separately accommodate the thumb and at least one other finger. In addition, for comfort and ease of use, both of the gripping portions are further provided with conformed areas for the other four fingers of the hand, when being used in either mode.

If desired, the device of the present invention may be utilized as a simple comb by using finger pressure to keep the bar member adjacent the ledge member. The protruding comb teeth are then used as a normal comb. In another modified use, the device can be utilized with short hair by using it in the reversed mode with the comb section being used to scoop the hair into engagement and locking with the bar member for short, quick and precise cutting.

Because of the natural curvature of people's heads it is preferred that the comb section have teeth extending over a length not in excess of four inches (10 cm), since such length is approximately the maximum for a straight layer along an average head curvature. The bar member should be dimensioned to have a length slightly in excess thereof for efficient hair layer lifting. The effective width (facing the ledge member) of the bar member should be as small as possible, while maintaining structural integrity, in order to permit sectioning of thin layers. As an example, a tapered width from 70 to 150 mils (1.7 to 3.75 mm) permits selective sectioning and lifting of layers of hair as thin as $\frac{1}{8}''$ (3 mm).

For ease of use and to minimize fatigue, the overall length of the device is preferably between 7 to 8 inches (17.5 to 20 cm) and the weight should not exceed about two ounces (57 gm). Accordingly, it is preferred that the device be made of a strong lightweight metal such as aluminum and more economically of a molded plastic material such as ABS, Lexan or nylon.

Because of the additional flexibility of plastic, the plastic version of the device of the present invention preferably embodies several modifications to accommodate the flexibility. Thus, it is preferred that the forward end of the ledge member have an upwardly extending restraining element or tooth which is spaced from the teeth of the comb section and the forward end at the tip of the bar member is sized to fit within such spacing. Outward flexing of the bar member, with the bar member falling off the ledge member, is thereby contained during the hair locking stage under exerted pressure.

To further ensure positioning of the bar member on the ledge member during the hair locking stage, positions of the gripping portions of both the comb member and sectioning member overlap each other such that to some extent the members cross each other. As a result, the sectioning member is thereby constantly urged towards the comb member.

A further preferred embodiment for the plastic version of the device of the present invention comprises making the surface of the bar member which is adjacent the ledge member, only partially co-linear therewith. The forward edge of the bar member is in abutment with the ledge member and, from there backwards towards the gripping portion, is taperingly slightly spaced from the ledge member such that exerted pressure on the rear of the sectioning member (as exerted by the fingers on the gripping portion) causes the bar member to flex and make full uniform pressure contact with the ledge member during the hair locking stage.

In both versions it is preferred, for facilitated manufacture, that the comb section be integrally formed with the comb member in a single forming operation. It is however possible to provide the comb member with comb retaining means such as a slotted track into which a separable comb section unit having, for example, different size, shape, number and spacing of teeth; can be inserted and retained. In a standard comb there are about 7 to 8 teeth per inch and a greater amount may be utilized for finer hair.

DETAILED DESCRIPTION OF THE DRAWINGS AND PREFERRED EMBODIMENT

Figure 2:
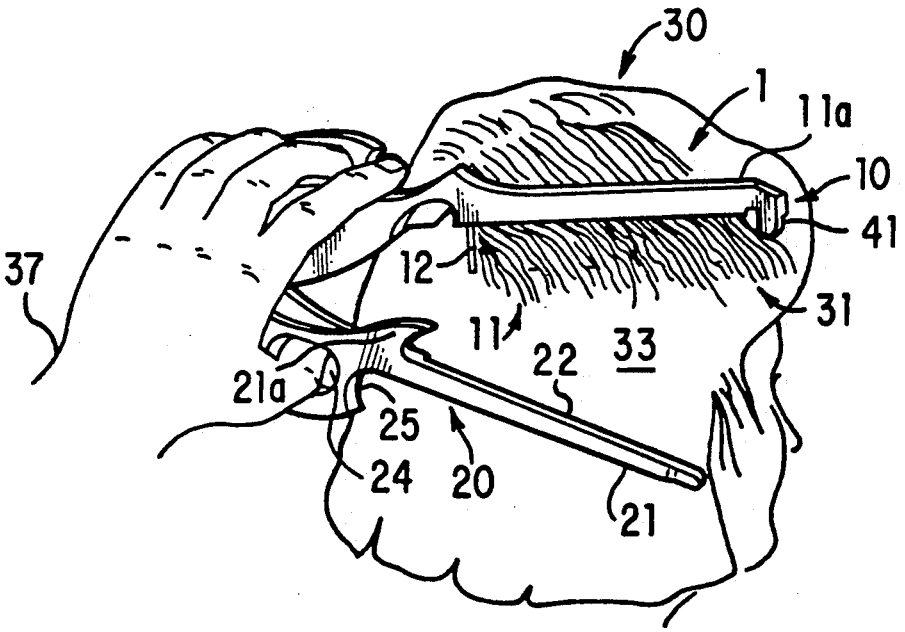
FIG. 2 is a further view of the device of FIG. 1 shown combing the sectioned layer.
Figure 3:
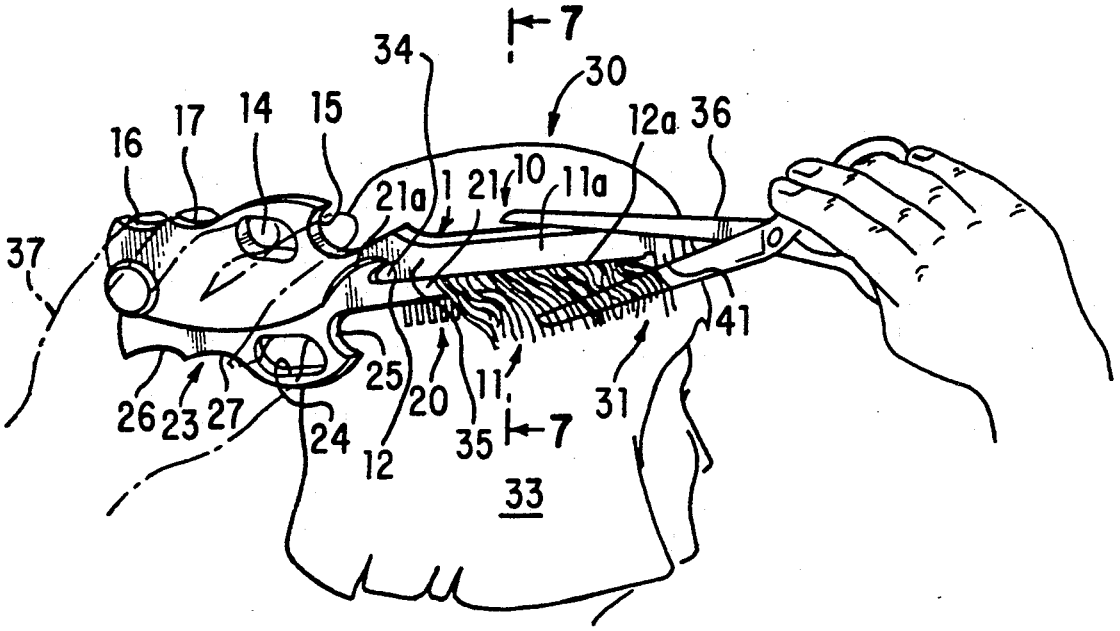
FIG. 3 is a final view of the device of FIGS. 1 and 2 shown locking the sectioned hair into a selected length and the use of a scissor to trim the hair.
Figure 4:
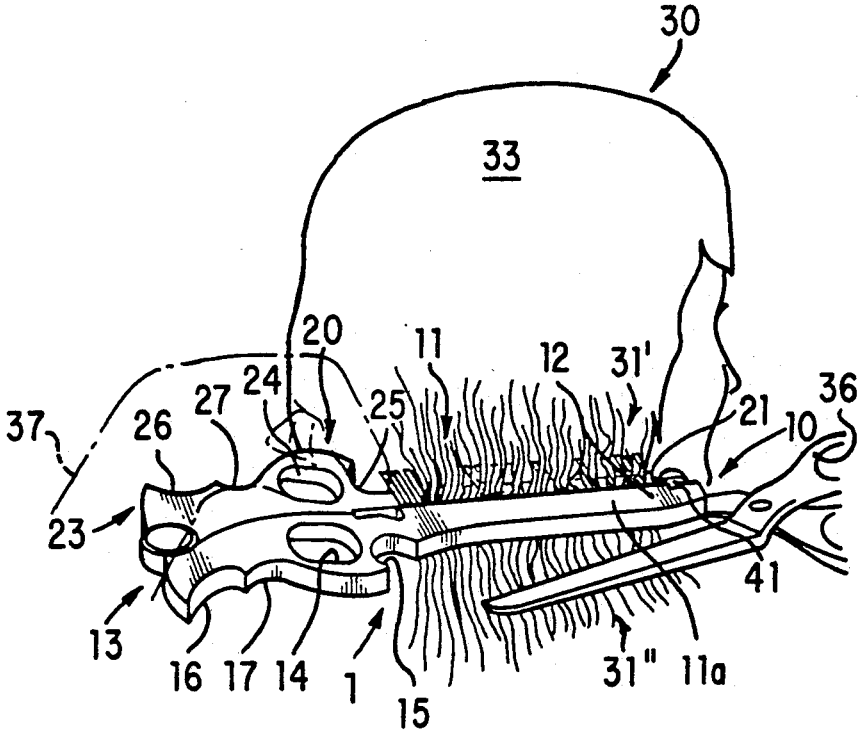
FIG. 4 depicts a reverse positioning of the device of FIGS. 1–3 for use in locking lower head hair ends into position for cutting.

With specific reference to the drawings, FIGS. 1–3 depict the sequential method of the present invention of sectioning, combing and locking for cutting. For facilitated understanding, the manipulating hand is shown in phantom by dashed lines. In FIGS. 1–4, hairstyling device 1 is shown in use adjacent head 30. As also seen in FIGS. 5 and 6, the device is comprised of comb member 10 attached to sectioning member 20 by a hinged connection, with hinge pin 38 placed through apertures 18 and 28 of the comb and sectioning members respectively, located at a distal end of each of the comb and sectioning bar members 10 and 20. The teeth 11 of the comb member extend downwardly toward the bar member 21 of the sectioning member 20, with the teeth and bar member being movable towards and away from each other by manual manipulation as shown in the sequence of FIGS. 1–3. The comb and sectioning members 10 and 20 each have gripping portions of handles 13 and 23 respectively, which are adjacently movable to permit the finger manipulation of the comb member teeth 11 and the bar member 21. The handles 13 and 23 are conformed to usage by a left hand 37 (the manipulating hand used by a right-handed person), shown with dashed lines. In FIGS. 1–3, the thumb of hand 37 is inserted into finger loop 24 in handle 23 and the middle finger of the same hand is inserted into finger loop 14. The remaining fingers of pinkie, ring and index are comfortably placed upon conformed areas 16, 17 and 15 respectively on handle 13 of comb member 10. The thumb, as shown, controls movement of the bar member and the remaining fingers control movement of the comb member. The thumb and middle finger of hand 37 cause comb member teeth 11 and bar member 21 to be moved apart by separation of these fingers. All the fingers are used to draw the comb member teeth 11 and bar member 21 together by movement of the thumb towards the remaining fingers. In addition, all the fingers are used to exert pressure to maintain the comb member teeth and bar member together as will be described. With reversal of gripping of the device, as shown in FIG. 4, for special purpose utilization, the middle finger is inserted into finger loop 24 and the thumb is inserted into finger loop 14. The handle 23 of the sectioning member also has conformed areas 26, 27 and 25 for comfortable accommodation of the pinkie, ring and index fingers of hand 37 in such reverse positioning. In this mode of utilization, the thumb controls movement of the comb member 10 and the remaining fingers control movement of the sectioning member 20.

In the normal utilization mode shown in FIGS. 1–3, the comb and sectioning members 10 and 20 are held in a position parallel to head 30 and the teeth 11 and bar member 21 are separated. The free tip of bar 21 is slightly tilted towards the hair 33 and inserted beneath a section of hair 31 which is then loosely held on the bar. The elongated tapered shape of the bar 21 enables it to be readily inserted beneath any thickness of hair layers including thin layers of hair for precision layered cutting. Stop element 21*a* serves to prevent the sectioned hair from falling off the far end of the bar 21. The sectioned hair 31 is then lifted by bar 21 away from the remaining hair 33 or the head and into engagement with comb member teeth 11 as shown in FIG. 2. The sectioned hair 31 is combed to the desired length and the teeth 11 and bar 21 are drawn together by all the fingers, as shown in FIG. 3, with the sectioned hair 31 being compressed and locked therebetween. As seen in FIGS. 3 and 7, the sectioning bar 21 is offset from the length 11 whereby it moves along the outer surface of the teeth 11 during such compression movement. A ledge member 12 protrudes outwardly from the base 11*a* of the teeth of the comb member and provides a stop for movement of the sectioning bar 21. Surface 12*a* of ledge member 12 and surface 22 of sectioning bar 21, which contact each other, are planar and the interface 32 of such surfaces is at right angles to the comb member teeth 11 and in line with the base of the teeth 11*a*. As a result, the sectioned and combed hair 31 is compressed and locked between the surfaces 12*a* and 22 and protrudes outwardly. In a substantially perpendicular direction, for facilitated precision cutting by a cutting device shown as scissors 36 held by the right hand of the user of the device. Outer surface 35 of both the ledge member 12 and the sectioning bar 21 is planar to facilitate proper placement and guided movement of the scissors 36 or other cutting devices such as clippers.

In order to prevent pinching of hair during the compression or locking phase, a through space 34 is provided between stop member 21*a* and the rear end of comb member teeth 11. Captured hair within this space is either loosely held (out of the path of the cutting device) or is permitted to fall back to the head.

The steps shown in FIGS. 1–3 are repeated until the hair styling cutting is completed.

The cutting mode shown in FIG. 4 entails flipping the device 1 along its longitudinal axis until the thumb is engaged with the handle 13 of comb member 10 and the remaining fingers engage the handle 23 of sectioning member 20 with, as described above, the handles being conformed for such engagement as well. This reverse engagement permits the device 1 to be held at right angles to the head 30 with a downward positioning of the band rather than in an awkward upward and backwardly bent hand position, for facilitated trimming of the lower hair ends closest to the neck. This utilization, such as for a bob cut, entails sectioning of a layer of hair 31' by the sectioning bar 21, and lifting the sectioned hair out into engagement with the comb member teeth 11 for combing. Thereafter the comb member and sectioning bar are moved into compressive locking engagement, with the scissors 36 being used to cut the protruding hair 31'' from below.

The hairstyling device 1 is comprised of a plastic material having some degree of resiliency. Accordingly, this embodiment includes upwardly protruding restraining element 41 at the forward end of ledge member 12 and which is spaced from the teeth 11 of the comb member. The tip of sectioning bar 21 is provided with an inset portion (clearly seen in FIG. 6) in order to enable the tip to fit between the restraining element 41 and the comb member teeth 11 during the locking phase. The restraining element 41 prevents the sectioning bar 21 from slipping off the ledge member 12 when compressive forces are exerted on the resilient sectioning bar by the fingers during the locking phase. In order to additionally urge the sectioning bar and comb member together, handles 13 and 23 have co-fitting cutouts 19 (shown in dotted lines) and 29 respectively which, in effect, provides for a cross-over of the comb and sectioning bar members. This results in an additional support for prevention of lateral separation of such members from each other.

As seen by dashed lines in FIG. 3, during the initial engagement between the surfaces 12*a* and 22, of ledge member 12 and sectioning bar 21, only the forward ends of such surfaces are in touching engagement. As compressive forces are exerted by the fingers, the resiliency of the plastic material permits the two surfaces to become fully engaged with the hair held therebetween being accordingly uniformly compressively held.

In a metal embodiment of the present invention wherein the degree of resiliency of the members is of a much lesser extent, the restraining element 41, overlapping of the handle elements and the initial spacing between the compressed surfaces are not as required.

It is understood that the above embodiment showing the method and device of the present invention is for illustrative purposes and that changes in utilization, structure, configuration and the like may be made without departing from the scope of the present invention as defined in the following claims.

What is claimed is:

1. A method for rapid precision cutting of hair on a person's head comprising the unencumbered sequential steps of:

a. sectioning a layer of hair by separating and lifting it away from the hair;

b. combing the sectioned layer of hair;

c. locking the sectioned layer of hair at a selected cutting length; and d. cutting the layer of hair at the selected cutting length; the improvement comprising the sectioned layer of hair being locked with a substantially uniform pressure, when the selected cutting length has been reached by the combing; and wherein the steps of sectioning, combing and locking are effected with a device manipulable with one hand without position re-orientation of the device in the hand during such steps, and wherein the device comprises a bar member tapered to a smaller cross-sectional dimension end, with said tapered end being inserted beneath the layer of hair, to effect the sectioning.

2. The method of claim 1, wherein the layer of hair is locked into a position thereby it extends in a direction substantially perpendicular to the head for facilitated cutting.

3. A hairstyling device, for use in conjunction with a hair cutting device, for rapid precision cutting of hair on a person's head, with the hairstyling device comprising means for sectioning a layer of hair, by lifting the layer of hair away from the hair; means for combing the sectioned layer of hair; and means for locking the sectioned hair at a selected cutting length for cutting by the hair cutting device, wherein the improvement comprises that the sectioning means, combing means and locking means are integrated, to be manipulable with one hand without position re-orientation of the hairstyling device in the hand during sectioning, combing and locking; and wherein the locking means locks the layer of hair in place with a substantially uniform pressure when the selected cutting length has been reached by the combing; wherein the sectioning means comprises a sectioning member comprised of an elongated bar member, having a free end, adapted to be inserted beneath a selected layer of hair and lifted away from the hair to effect the sectioning; and wherein the bar member is tapered to a smaller cross-sectional dimension, at the free end whereby the bar member can be utilized to section thin layers of hair.

4. The hairstyling device of claim 3, wherein the combing means comprises a comb member having a gripping section and a comb section, with the comb section having teeth and a base from which the teeth extend; and wherein the sectioning means comprises a sectioning member comprised of an elongated bar member and a gripping section, the bar member being adapted to be inserted beneath a selected layer of hair and lifted away from the remaining hair to effect the sectioning; wherein the gripping sections of the comb member and sectioning member are hingedly attached, whereby the teeth of the comb section extend in a direction toward the bar member and wherein the teeth and bar member are movable toward and away from each other, to and from an adjacent juxtaposition by relative movement of the gripping sections.

5. The hairstyling device of claim 4, wherein the sectioning member further comprises stop means, at a point between the bar member and the position at which the gripping sections of the comb member and sectioning member are hingedly attached, to prevent sectioned hair from being caught and pinched by the hinged attachment.

6. The hairstyling device of claim 5, wherein the stop means comprises a tooth-like extension member on the sectioning member extending in a general direction towards the teeth of the comb section.

7. The hairstyling device of claim 6, wherein a free space between an end of the combing teeth and the tooth-like extension member, when the bar member and combing teeth are in adjacent juxtaposition, is provided to permit excess hair to either fall out or be loosely held without pinching during locking of the layer of hair.

8. The hairstyling device of claim 3 wherein the bar member is tapered to a blunt tip.

9. The hairstyling device of claim 8 wherein the bar member is movable along a lateral surface of the teeth of the comb section.

10. The hairstyling device of claim 9 wherein the locking means comprises a ledge member, laterally adjacent to the comb section, which acts as a stop for the bar member and wherein the layer of hair is locked therebetween.

11. The hairstyling device of claim 10 wherein the ledge member and bar member have a planar interface whereby hair locked therebetween is brought to a position substantially perpendicular to the person's head for facilitated cutting by the hair cutting device.

12. The hairstyling device of claim 11 wherein a portion of the base of the teeth of the comb section, to which the teeth are attached, laterally coincides with the planar interface.

13. The hairstyling device of claim 12 wherein the gripping sections of each of the comb member and sectioning member are hingedly connected at their distal ends.

14. The hairstyling device of claim 13 wherein said one hand is comprised of a thumb and four fingers and wherein each of said gripping sections is conformed to a grip by either the thumb or the four fingers of the one hand.

15. The hairstyling device of claim 14 wherein each of said gripping sections comprises at least one peripheral enclosure for the insertion and enclosure thereby of one of said fingers to permit leverage for the finger when inserted and enclosed to enable the inserted and enclosed finger to separate the comb section from the bar member.

16. The hairstyling device of claim 11 wherein the hairstyling device is comprised of a plastic material having resilience and wherein the ledge member further comprises a restraining member for restraining the bar member from slipping off the ledge member, under locking pressure, as a result of the resilience of the plastic.

17. The hairstyling device of claim 16 wherein said restraining member comprises a tooth member on a portion of the ledge member which acts as a stop for the tip of the bar member, with said tooth member extending in a direction opposite that of the teeth of the comb member and being spaced from the comb member for a distance sufficient to permit the tip of the bar member to fit therebetween.

18. The hairstyling device of claim 16 wherein the ledge member and bar member form the planar interface upon compression during locking.

19. A hairstyling device, for use in conjunction with a hair cutting device, for rapid precision cutting of hair on a person's head, with the hairstyling device being manipulable by one hand and comprising a comb section having teeth and a base from which the teeth extend; and a sectioning member comprised of an integrated tapered elongated bar member and a gripping section, the bar member being adapted to be inserted beneath a selected layer of hair and lifted away from the hair into engagement with the comb section for combing of the selected layer of hair; wherein the gripping sections of the comb member and sectioning member are hingedly attached, whereby the teeth of the comb section extend in a direction toward the bar member and wherein the teeth and bar member are movable toward and away from each other, to and from an adjacent juxtaposition, by relative movement of the gripping sections, with the bar member being movable along a lateral surface of the teeth of the comb section and wherein a ledge member, laterally adjacent to the comb section, along the length thereof, acts as a stop for the bar member at the adjacent juxtaposition and wherein the layer of hair is locked therebetween, with the ledge member and bar member having a planar interface, and a portion of the base of the teeth of the comb section, from which the teeth extend, laterally coinciding with the planar interface, whereby hair locked between the ledge and bar members is brought to a position substantially perpendicular to the person's head for facilitated cutting by the hair cutting device; the sectioning member further comprising a tooth-like extension member, extending in a general direction towards the teeth of the comb section, from a point on the sectioning member between the bar member and the hinged attachment of the gripping sections, to prevent the sectioned layer of hair from being caught and pinched by the hinged attachment, and with a free space between an end of the teeth of the comb and the tooth-like extension member, when the bar member and teeth of the comb are in adjacent juxtaposition, to permit excess hair to either fall out or be loosely held without pinching during locking of the layer of hair; and wherein said one hand is comprised of a thumb and four fingers and wherein each of the gripping sections is conformed to a grip by either the thumb or the four fingers of the one hand and each gripping section comprises at least one peripheral enclosure for insertion and enclosure therewithin of one of the four fingers or thumb to permit leverage for the finger or thumb, when inserted and enclosed, to enable the inserted finger or thumb to separate the comb section from the bar member.

* * * * *